United States Patent [19]

Miller

[11] Patent Number: 4,717,154

[45] Date of Patent: Jan. 5, 1988

[54] DICE GAME

[76] Inventor: David F. Miller, 2351 Edith Avenue, Burlington, Ontario L7R 1N4, Canada

[21] Appl. No.: 830,360

[22] Filed: Feb. 18, 1986

[30] Foreign Application Priority Data

Feb. 28, 1985 [CA] Canada ..... 475361

[51] Int. Cl.[4] ..... A63F 3/00

[52] U.S. Cl. ..... 273/243; 273/146

[58] Field of Search ..... 273/146, 243, 272, 248, 273/259, 244, 246

[56] References Cited

U.S. PATENT DOCUMENTS 1,697,023 1/1929 Rottenburg ..... 273/146

2,611,616 9/1952 Kloss ..... 273/243

OTHER PUBLICATIONS

Games and Puzzles Magazine; Oct. 1977; p. 39.

*Primary Examiner*—Richard C. Pinkham

*Assistant Examiner*—Matthew L. Schneider

*Attorney, Agent, or Firm*—Burke-Robertson, Chadwick & Ritchie

[57] ABSTRACT

There is provided a new and useful game apparatus for combining chance play with mathematical operation. The apparatus comprises a game board having a playing surface laid out with a sequence of numbered playing spaces, a set of markers for use in marking positions within the sequence of playing spaces, and at least two dice each marked on the sides thereof with a series of numbers. The numbers in the group of series on the dice form a number set. Each series in the number set is chosen such that the first number in the first series is zero or one. If the first number in the first series is zero, then one number in each other series may be zero and otherwise no two numbers are the same within the set and each number in each series subsequent to the first series is larger than any number in any preceding series. If the first number in the first series is one, then one number in each other series may be zero, one number of the second series may be the same as the highest number of the first series, and otherwise no two numbers are the same within the set and each number in each series subsequent to the first series is larger than any number in any preceding series.

9 Claims, 3 Drawing Figures

DICE GAME

This application relates to a game apparatus for combining chance play with mathematical operation.

BACKGROUND OF THE INVENTION

There have been developed over the years many games and game apparatus the object of which is to combine a pastime which is fun for the participant but which also contributes educationally. Such games involve numbers, letters and combinations of these; and appear in many formats, including cards, game boards and the like.

A difficulty which has arisen in respect of most of these educational games in the past is that they are quite substantially limited in scope. For example, in the vast majority of cases where dice form a part of the game apparatus, the dice are conventional cubes bearing numbers from one to six on the respective sides. Their use is therefore generally limited to a very low level of arithmetic manipulation, since frequently only two dice are used. This severely limits the range of numbers that are available. Even where additional dice are used, the range of numbers available for manipulation is low.

Against this background a game apparatus has been devised which features a unique type of dice which greatly facilitates the range of numbers available and consequently the scope of arithmetic manipulation which may be utilized.

PRIOR ART

Applicant is unaware of any prior art which relates directly to the invention of the present case.

Of marginal interest is Canadian Pat. No. 190,271, issued May 13, 1919, to Carl Jentz, covering a game apparatus including conventional dice plus a die upon which the arithmetic symbols are displayed.

Canadian Pat. No. 1,044,268, issued Dec. 12, 1978, to Wicks and Nemer, utilizes slightly modified conventional dice.

Canadian Pat. No. 1,164,205, issued Mar. 27, 1984, to Harry Sisak, also includes modified conventional dice, one of which includes arithmetic symbols.

None of these prior patents remotely contemplates the apparatus of the present invention.

SUMMARY OF THE INVENTION

The present invention utilizes unique sets of dice which may be chosen in any one of a variety of configurations to increase or decrease the complexity of the game. The scope of numbers available for use in the game is substantially larger than is the case using conventional dice and, consequently, the degree of difficulty and range of manipulation of arithmetic operations can be progressive to reach a substantial degree of difficulty.

Accordingly, the invention provides a game apparatus for combining chance play with mathematical operation comprising a game board having a playing surface laid out with a sequence of numbered playing spaces, a set of markers for use in marking positions within the said sequence of playing spaces, and at least two dice each marked on the sides thereof with a series of numbers, the numbers in the group of series forming a number set, each series in the set chosen such that (a) the first number in the first series is zero or one, (b) if the first number in the first series is zero, then one number in each other series may be zero and otherwise no two numbers are the same within the set, and (c) if the first number in the first series is one, then one number in each other series may be zero, one number of the second series may be the same as the highest number of the first series, and otherwise no two numbers are the same within the set.

GENERAL DESCRIPTION

While the specific configuration of the game board and the specific rules to be applied to a given game are highly variable and provide a wide scope for innovation on the part of a user, in all cases the games will centre around unique sets of dice having general characteristics which can readily be varied to affect the scope and complexity of the game.

The basic requirement for the dice is that at least two dice are used and that, with the exception to be discussed below, no number from one die appears on any other die. The numbering is preferably chosen such that the additive total of the numbers showing on a throw of the dice can include all numbers between zero and the highest such additive number. In another preferred embodiment the lowest number on one of the dice will be one, so that the lowest number available on a throw of the dice will be one.

In general terms the preferred numbering of the dice is to begin numbering the first die with one or zero and continue sequentially until all sides of the die have been numbered. The second die then begins with zero. If the first die began with one, then the second number of the second die is the same as the highest number on the first die. If the first die began with a zero, then the second number of the second die is equal to the highest number of the first die plus one. Along with the zeros, this latter case is preferably the only one where a number is repeated in the set. Subsequent numbers on the second die then preferably proceed suquentially in multiples of the second number of that die. Subsequent dice have as their first number zero and otherwise continue sequentially from the last number of the second die with multiples of the second number of the second die.

Any number of dice may be used and the dice may have any number of sides. It is contemplated generally that all dice used with a particular game board will have the same number of sides. Clearly the magnitude of the numbers and the quantity of numbers available for manipulation increase with increasing sides and with increasing number of dice.

The complexity may be increased by utilizing, in addition, a die or dice on which at least one side would bear mathematical or other symbols requiring manipulation of the numbers thrown. For example, a die could be used on which all sides contain mathematical or other manipulative symbols.

A basic game can be played utilizing these dice in combination with a board having a numbered series of spaces for movement on the board and markers for movement in co-operation with the spaces. A basic game would simply be to roll the dice and add the numbers thrown to obtain the number of spaces to be moved. Additional rules as desired can then be introduced to assign special functions to specific numbers thrown or to utilize various mathematical functions either with or without the special mathematical function die described above. For example, the concept of factors can be utilized extensively and forms a substantial mathematical exercise. Thus, if a person were to throw the dice to yield a total of, say, thirty-two, then different counting numbers; i.e., number of spaces to be moved on the board, could be determined based on a breakdown of the total into various factors, such as eight and four, and sixteen and two.

The dice described above offer substantial advantages over standard dice. For example, zero and one values cannot be obtained when tossing two standard dice and the odds on tossing two particular number vary from one in thirty-six for two and twelve to six in thirty-six for seven. As described above, not only are values of zero on one available, but all values can be obtained from zero to the highest additive number available on the throw of the dice and the odds can be the same for all numbers, depending on the set chosen.

BRIEF DESCRIPTION OF THE DRAWINGS

In drawings which illustrate embodiments of the invention.

Figure 1:
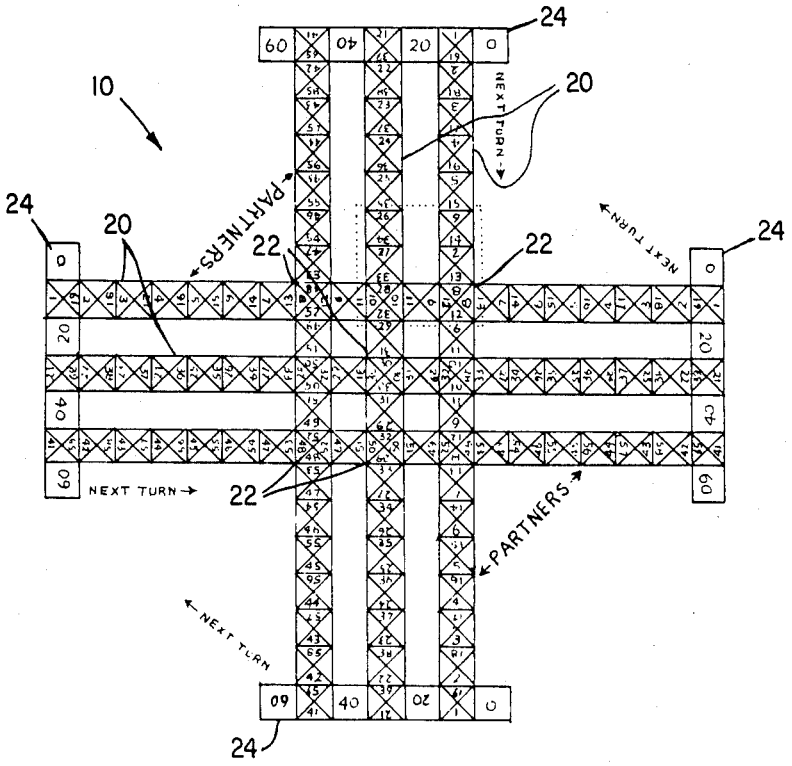
FIG. 1 illustrates a configuration of a basic board format for use in the apparatus.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE INVENTION

In the following description, similar features in the drawings have been given similar reference numerals.

While the configuration of the board can vary over a wide range, that illustrated in FIG. 1 is one basic arrangement that has been found to be functionally very acceptable. The board 10 is comprised of a series of strips 20 which intersect at various points 22 and are interconnected at the ends through transfer strips 24. As illustrated, partners sit adjacent one another and the turn moves in a figure eight fashion around the board. The object is for each player to move his marker through the numbered spaces in strips 20 to achieve in the case illustrated sixty points or a multiple of sixty. Note that opposing players move counter to each other through the strips.

Most conveniently the FIG. 1 representation can be printed or otherwise laid down on a folding square board surface in conventional fashion.

In a layout such as that of FIG. 1, the most preferred dice arrangement is to utilize three dice numbered as follows:

| | | | | | | |
|---|---|---|---|---|---|---|
| SERIES 1 DIE | 0 | 1 | 2 | 3 | 4 | 5 |
| SERIES 2 DIE | 0 | 6 | 12 | 18 | 24 | 30 |

-continued

| | | | | | | |
|---|---|---|---|---|---|---|
| SERIES 3 DIE | 0 | 36 | 42 | 48 | 54 | 60 |

That set of dice will in at least one combination produce all of the numbers between zero and ninety-five, the latter being the highest number obtainable by adding the highest values of the three dice. In another variation for use with the basic board layout, if only the first two of the dice just described are used, then all of the numbers from zero to thirty-five are available and each is available from only one combination of the dice. Thus, the odds of throwing any of the numbers are equal. This is, of course, in marked contrast to the situation with standard dice.

A further variation which allows a number of dice to be rolled and yet maintains equal odds for each number rolled is as follows. A selective die is included which specifies which die is to be counted with the lowest or first die. For example, if three series die of six sides each are used, then a selective die will be used bearing on its six faces the numbers 2, 3, 2, 3, 2, 3, indicating which of dice 2 or 3 is to be counted with the lowest die, die 1. In this way there is an equal chance of counting any of the set of numbers. A selective die can similarly be used for any number of dice rolled.

While the dice described just above are six-sided ones, any desired number of sides can be utilized along with any desired number of the dice. Additional dice are numbered in the same way by continuing with multiples of a base number, in the illustrated case, six.

The manner of numbering the dice is generally as follows. The first die can begin with either a zero or a one, depending on whether it is desired to include zero as one of the rolls that can be obtained from the number set. Each of the other dice will also include a zero which may for convenience be stated to be the first number of each subsequent die. Where the first die begins with a zero the remaining sides of that die will contain the sequential numbers from one to one less than the number of sides. The second number of the second die will then be one greater than the last or highest number in the series on the first die. With the exception of the zero which appears on all subsequent dice, the numbering of subsequent dice will be in multiples of the second number of the second die.

In a situation where the first die has as its lowest number one, so that the number set consisting of the series appearing on each die will also begin with one, the second number of the second die will be the same as the last or highest number of the first die. This latter arrangement is illustrated as follows:

| | | | | | | |
|---|---|---|---|---|---|---|
| SERIES 1 DIE | 1 | 2 | 3 | 4 | 5 | 6 |
| SERIES 2 DIE | 0 | 6 | 12 | 18 | 24 | 30 |
| SERIES 3 DIE | 0 | 36 | 42 | 48 | 54 | 60 |

These two major options can generally be expressed by the following formula:

| SIDE: | 1 | 2 | 3 | 4 | 5 . . . x |
|---|---|---|---|---|---|
| SERIES 1 DIE: | 0 | 1 | 2 | 3 | 4 . . . x − 1 |
| SERIES 2 DIE: | 0 | x | 2x | 3x | 4x . . . (x − 1)x |
| SERIES 3 DIE: | 0 | (x − 1)x + x | (x − 1)x + 2x . . . 2(x − 1)x | | |

-continued

| SIDE: | 1 | 2 | 3 | 4 | 5 . . . x |
|---|---|---|---|---|---|
| SERIES 4 DIE: | 0 | 2(x − 1)x + x | 2(x − 1)x + 2x . . . 3(x − 1)x | | |
| SERIES Y DIE: | 0 | (y − 2)(x − 1)x + x | (y − 2)(x − 1)x + 2x . . . (y − 1)(x − 1)x | | |

In the second formula the first side of the first die would be numbered one to x and the remaining sides would be identical in numbering to those of the first formula.

In these generalizations x is the number of sides of each die and y is the number of dice. It is not necessary, however, that all sides of the dice be numbered. For example, eight-sided dice could be treated as six-sided dice for numbering and the remaining two sides used for mathematical or other symbols.

While the above expresses the basic preferred number combinations, it should be clear that various combinations of the dice can be used to obtain different variations in accordance with different rules which might be devised. For example, four dice might be used with each player having two throws, each throw utilizing two of the dice, and the dice may be in a broken series such as the first and third dice described above in one throw and the second and a fourth dice in the other throw. It should be noted that in utilizing standard dice, the same range of numbers are available no matter which pair of dice are thrown; whereas, with the dice of the present invention, wholly different sets of numbers become available depending on which dice are thrown.

In addition to the dice described thus far, additional types of dice such as those bearing mathematical symbols may also be utilized to add further complexity and scope to the game.

Figure 2:
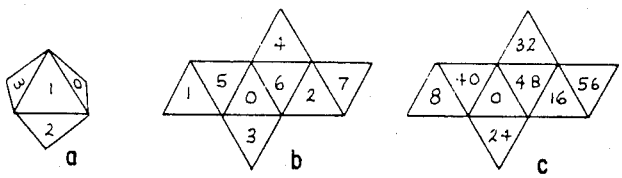
FIG. 2 illustrates a pair of eight-sided die forms utilizing the preferred numbering system.
Figure 3:
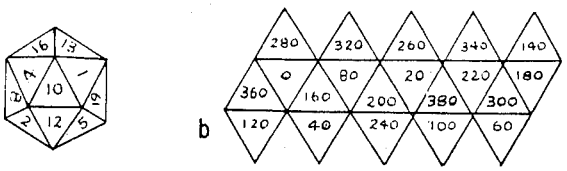
FIG. 3 illustrates a twenty-sided die form utilizing the preferred numbering system.

FIGS. 2 and 3 illustrate configurations of eight- and twenty-sided dice. FIGS. 2*a* and 2*b* illustrate a first of a pair of eight-sided dice and include numbers from zero to seven. FIG. 2*c* illustrates the second of a pair of eight-sided dice and begins with a zero side, followed by an eight side and subsequently by sides bearing multiples of eight.

FIG. 3*a* illustrats in a similar manner the numbering of a twenty-sided die from one to twenty and FIG. 3*b* illustrates the numbering of the second die of twenty-sided pair.

As is evident from the illustrations set out thus far, regardless of the manner of numbering the first die, the second die will have as its second number the number equal to the number of sides of the die, when the dice are constructed in accordance with the preferred embodiment.

Thus it is apparent that there has been provided in accordance with the invention a game apparatus combining chance play with mathematical operation that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A game apparatus for combining chance play with mathematical operation comprising:

a game board having a playing surface laid out with a sequence of numbered playing spaces;

a set of markers for use in marking positions within the said sequence of playing spaces; and at least two dice each said die marked on the sides thereof with a different series of numbers, all said series together forming a group of series beginning with a first lowest series and increasing to a final highest series, the numbers in said group of series forming a number set, and each series in the set chosen such that (a) the first number in the first series is zero or one, (b) if the first number in the first series is zero, then one number in each other said series may be zero and otherwise (i) no two numbers are the same within the set, and (ii) each number in each series after said first series is higher than all numbers in all lower said series; and (c) if the first number in the first series is one, then one number in each other said series may be zero, one number of the second series may be the same as the highest number of the first series, and otherwise (i) no two numbers are the same within the set, and (ii) each number in each series after said first series is higher than all numbers in all lower said series.

2. The apparatus of claim 1 wherein the set of numbers is chosen such that all numbers from the minimum to the maximum inclusive in the set can be obtained by the various combinations showing on the rolls of the dice.

3. The apparatus of claim 2 in which the apparatus includes Y dice and each die has a preselected number of sides X where the sides are numbered as follows:

| SIDE: | 1 | 2 | 3 | 4 | 5 . . . x |
|---|---|---|---|---|---|
| SERIES 1 DIE: | 0 | 1 | 2 | 3 | 4 . . . x − 1 |
| SERIES 2 DIE: | 0 | x | 2x | 3x | 4x . . . (x − 1)x |
| SERIES 3 DIE: | 0 | (x − 1)x + x | (x − 1)x + 2x . . . 2(x − 1)x | | |
| SERIES 4 DIE: | 0 | 2(x − 1)x + x | 2(x − 1)x + 2x . . . 3(x − 1)x | | |
| SERIES Y DIE: | 0 | (y − 2)(x − 1)x + x | (y − 2)(x − 1)x + 2x . . . (y − 1)(x − 1)x | | |

4. The apparatus of claim 3 wherein the first die is numbered from one to x and all other dice are numbered as specified in that claim.

5. The apparatus of claim 3 including three dice of six sides each numbered as follows:

| SIDE: | 1 | 2 | 3 | 4 | 5 | 6 |
|---|---|---|---|---|---|---|
| SERIES 1 DIE: | 0 | 1 | 2 | 3 | 4 | 5 |
| SERIES 2 DIE: | 0 | 6 | 12 | 18 | 24 | 30 |
| SERIES 3 DIE: | 0 | 36 | 42 | 48 | 54 | 60 |

6. The apparatus of claim 5 including, in addition, a selective die of six sides of which three sides bear a designation identifying the series 2 die and three sides bear a designation identifying the series 3 die.

7. The apparatus of claim 3 including three dice of six sides each numbered as follows:

| SIDE: | 1 | 2 | 3 | 4 | 5 | 6 |
|---|---|---|---|---|---|---|
| SERIES 1 DIE: | 1 | 2 | 3 | 4 | 5 | 6 |
| SERIES 2 DIE: | 0 | 6 | 12 | 18 | 24 | 30 |
| SERIES 3 DIE: | 0 | 36 | 42 | 48 | 54 | 60 |

8. The apparatus of claim 7 including, in addition, a selective die of six sides of which three sides bear a designation identifying the series 2 die and three sides bear a designation identifying the series 3 die.

9. The apparatus of claim 1 in which said at least two dice include identifying symbols and wherein said apparatus includes in addition a selective die each side of which includes at least one of said identifying symbols for selectively identifying one of the at least two dice.

* * * * *